US005554038A

United States Patent [19]

Morlion et al.

[11] Patent Number: 5,554,038

[45] Date of Patent: Sep. 10, 1996

[54] CONNECTOR FOR SHIELDED CABLES

[75] Inventors: Danny Morlion, St. Amandsberg; Luc Jonckheere, Dilbeek; Jan P. K. van Koetsem, Zwijndrecht; Eddy K. Creëlle, Dendermonde, all of Belgium

[73] Assignee: Framatome Connectors International, Paris, France

[21] Appl. No.: 340,226

[22] Filed: Nov. 16, 1994

[30] Foreign Application Priority Data

Nov. 19, 1993 [NL] Netherlands ..... 9302007

[51] Int. Cl.[6] ..... H01R 13/652

[52] U.S. Cl. ..... 439/108; 439/540.1; 439/98; 439/374

[58] Field of Search ..... 439/108, 540, 439/291, 293, 94, 299, 346, 374, 527, 98

[56] References Cited

U.S. PATENT DOCUMENTS

| | | | |
|---|---|---|---|
| 3,179,914 | 4/1965 | Uberbacher | 339/49 |
| 3,569,900 | 3/1971 | Uberbacker | 439/579 |
| 4,767,345 | 8/1988 | Gutter et al. | 439/497 |
| 5,114,364 | 5/1992 | Hunter | 439/497 |
| 5,122,077 | 6/1992 | Maejima et al. | 439/701 |
| 5,169,324 | 12/1992 | Lemke et al. | 439/108 |
| 5,190,476 | 3/1993 | Chaillot | 439/680 |
| 5,224,867 | 7/1993 | Ohtsuki et al. | 439/108 |
| 5,288,250 | 2/1994 | Sumida | 439/701 |
| 5,385,490 | 1/1995 | Demeter et al. | 439/579 |

FOREIGN PATENT DOCUMENTS

| | | |
|---|---|---|
| 0284245 | 9/1988 | European Pat. Off. . |
| 9100441.1 | 5/1992 | Germany . |
| WO92/22943 | 12/1992 | WIPO . |

*Primary Examiner*—Gary F. Paumen
*Assistant Examiner*—Brian J. Biggi
*Attorney, Agent, or Firm*—Perman & Green

[57] ABSTRACT

A connector for shielded cables comprises a housing of insulating material and signal and ground contacts accommodated in said housing and to which corresponding conductors of the cables are connectable, said contacts being arranged in rows and columns. The housing is assembled of one or more modules and at least one module cap, wherein each module can be detachably mounted in the module cap in a predetermined position with respect to the module cap, and wherein each module is provided with at least one column of contacts.

12 Claims, 11 Drawing Sheets

CONNECTOR FOR SHIELDED CABLES

BACKGROUND OF THE INVENTION

The invention relates to a connector for shielded cables, comprising a housing of insulating material and signal and ground contacts accommodated in said housing and to which corresponding conductors of the cables are connectable, said contacts being arranged in rows and columns.

Such connectors are known in several embodiments. Generally, the number of signal and ground contacts of the connector and thereby the dimensions of the housing of the connector is adapted to the number of shielded cables to be connected by one connector to a coupling socket as required by the user. This means that a large number of different connectors has to be manufactured. Moreover, the housing of the usual connector consists of one part or a plurality of permanently assembled parts, whereby a repair of the connector for a fault in one cable is difficult.

It is therefore an object of the invention to provide a connector of the above-mentioned type which is made in such a manner that the dimensions of the connector can be adapted to the required number and type of cables to be connected in a very simple manner.

SUMMARY OF THE INVENTION

To this end the connector of the invention is characterized in that the housing is assembled of one or more modules and at least one module cap, wherein each module can be detachably mounted in the module cap in a predetermined position with respect to the module cap, and wherein each module is provided with at least one column of contacts.

Thereby, a connector is obtained which by combining one or more module caps with one or more modules can be adapted to the number of cables to be connected to the connector. As each module can only be mounted in one predetermined position in the module cap, connection errors are excluded. Different modules can be provided for different types of cables. Thereby, the connector of the invention can be easily adapted to the requirements of the user. Moreover, repair of the connector is possible in a simple manner.

BRIEF DESCRIPTION OF THE INVENTION

The invention will be further explained hereinafter by reference to the drawings in which several embodiments of the connector according to the invention are shown.

DETAILED DESCRIPTION OF THE PREFERRED EMBODIMENTS

Figure 1:
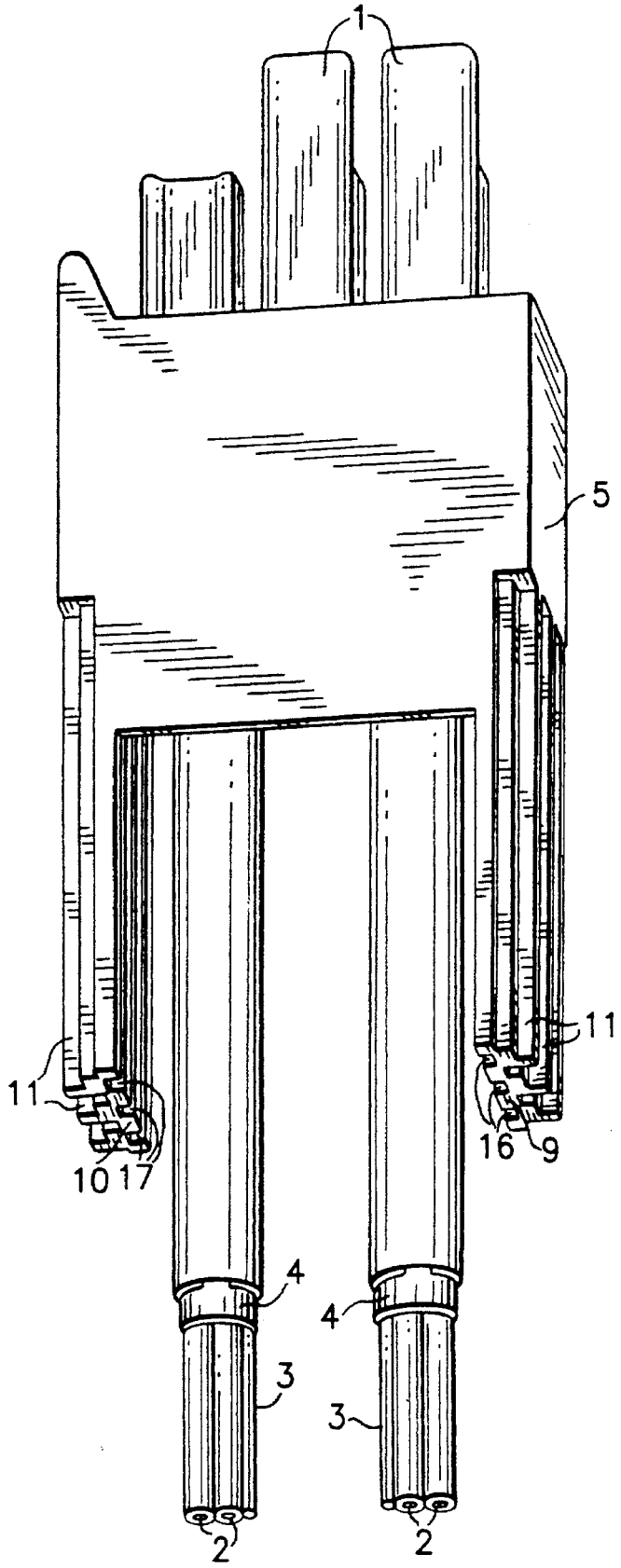
FIG. 1 shows a perspective view of a module cap of a first embodiment of the connector according to the invention, wherein two shielded cables with a differential pair of signal conductors to be connected are shown.

Referring to FIGS. 1–5 there is shown a first embodiment of the connector according to the invention, which connector in this case is intended for connecting shielded cables 1 with a differential pair of signal conductors 2 and a ground or drain wire 3 which are together enclosed by a metallized foil 4 working as a shielding. FIG. 1 shows a module cap 5 suitable for receiving three modules 6 which are further shown in FIGS. 2–4.

An upper wall of the module cap 5 which cannot be seen in FIG. 1, is provided with inlet openings for the cables 1. The module cap 5 comprises strain relief means for the cables 1 which in this case are made as supports 7, the opposite main faces of which are adapted to the shape of the cables 1. The cables 1 are clamped on a support 7 by a shrink sleeve 8 (see FIGS. 4 and 5) two by two, whereby the desired strain relief is obtained.

Figure 5:
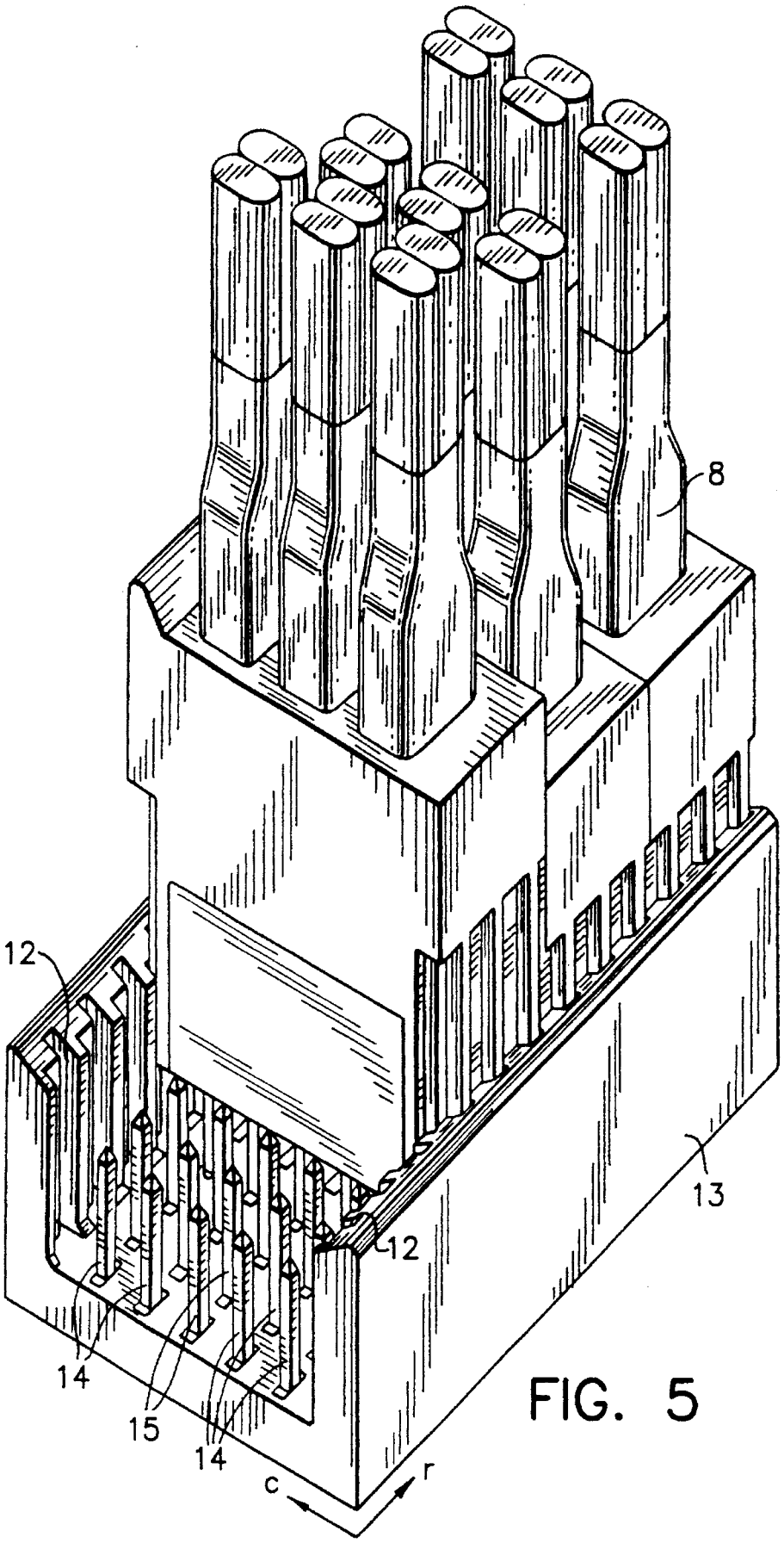
FIG. 5 shows a perspective view of a coupling socket with signal and ground contact pins, wherein three connectors according to FIGS. 1–4 are plugged into the coupling sockets.

The module cap 5 is provided with two opposite side walls 9, 10 which at the outer side each are provided with a step-like guiding profile or shape 11 adapted to cooperate with a complementary step-like guiding profile 12 of a coupling socket 13 shown in FIG. 5 and in which signal contact pins 14 and ground contact pins 15 are arranged in rows and columns. The row direction is indicated by r and the column direction by c. As the step shapes are mirror symmetrical with respect to the row direction, the module cap can be plugged into the coupling socket 13 in one position only. Of course, other profile shapes are also possible and the side walls 9, 10 can be provided with different profile shapes or one side wall 9, 10 can be flat.

Both side walls 9, 10 of the module cap 5 are provided at their inner side with first guiding slots 16 and second guiding slots 17 lying at a fixed intermediate spacing. In the embodiment shown the guiding slots 16 are straight whereas the guiding slots 17 are dovetail-shaped. Of course, the guiding slots 16, 17 can be shaped in a different manner.

Each module 6 comprises a housing made of insulating material and in which in this embodiment a central ground contact 18 and at both sides of the ground contact 18 two signal contacts 19 are provided. The contacts 18, 19 are aligned in column direction. The outer walls 20, 21 extending in row direction are provided with guiding ribs 22, 23 which can be fittingly received in the guiding slots 16, 17. Thereby, the modules 6 can be mounted in the module cap in one position only with respect to the module cap 5. The attachment of a module 6 in the module cap 5 can be provided by a snap connection for example. To this end it is for example possible to provide a small nose in one or both guiding slots near the upper wall of the module cap 5 cooperating with a recess in the guiding ribs 22, 23. In this manner a simple detachable mounting is possible.

Figure 2:
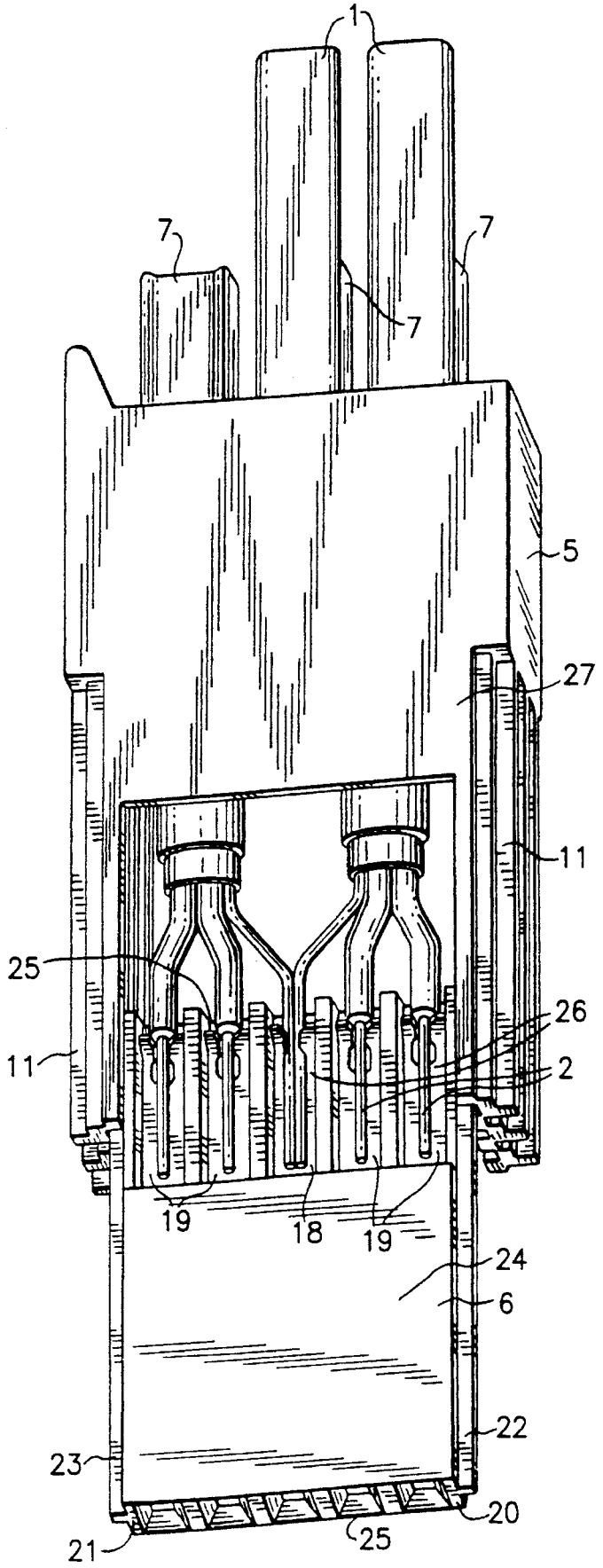
FIG. 2 shows a perspective view of the module cap of FIG. 1, wherein the signal and ground conductors of the cables are connected to the corresponding contacts of a module.
Figure 3:
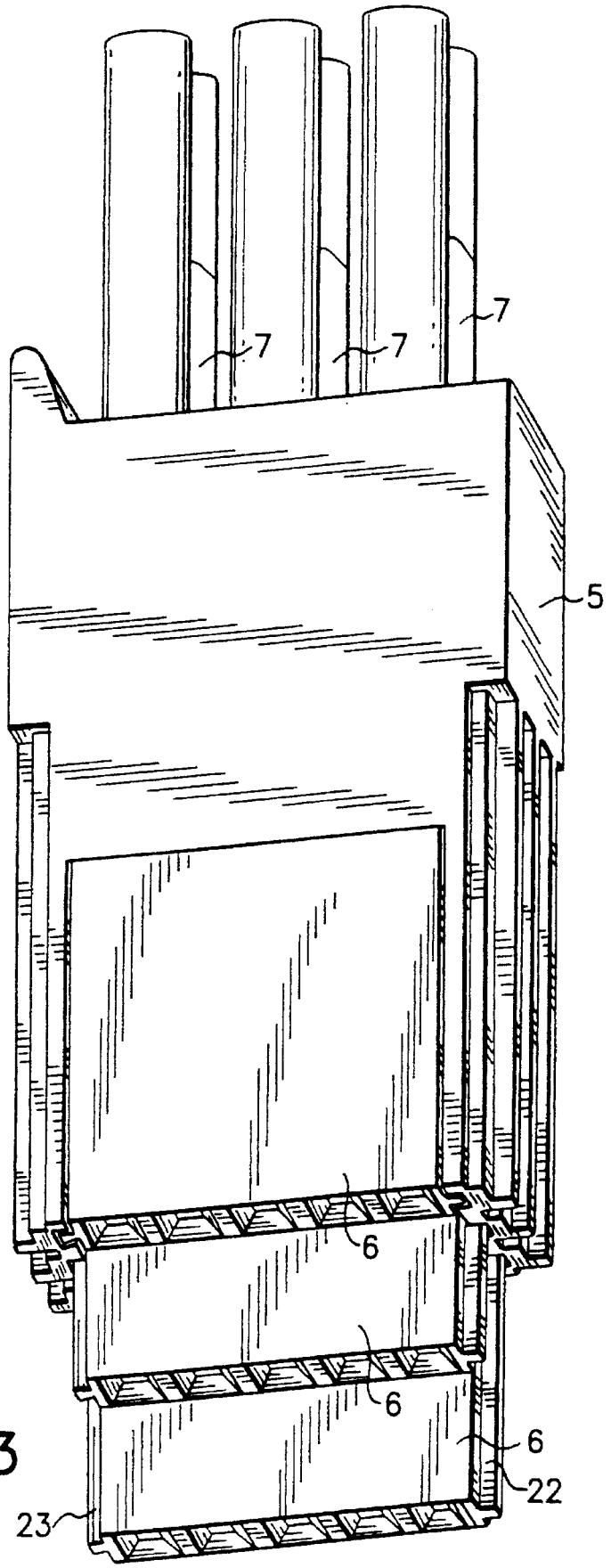
FIG. 3 shows a perspective view of the module cap of FIG. 1, wherein three modules are shifted into the module cap in different positions.
Figure 4:
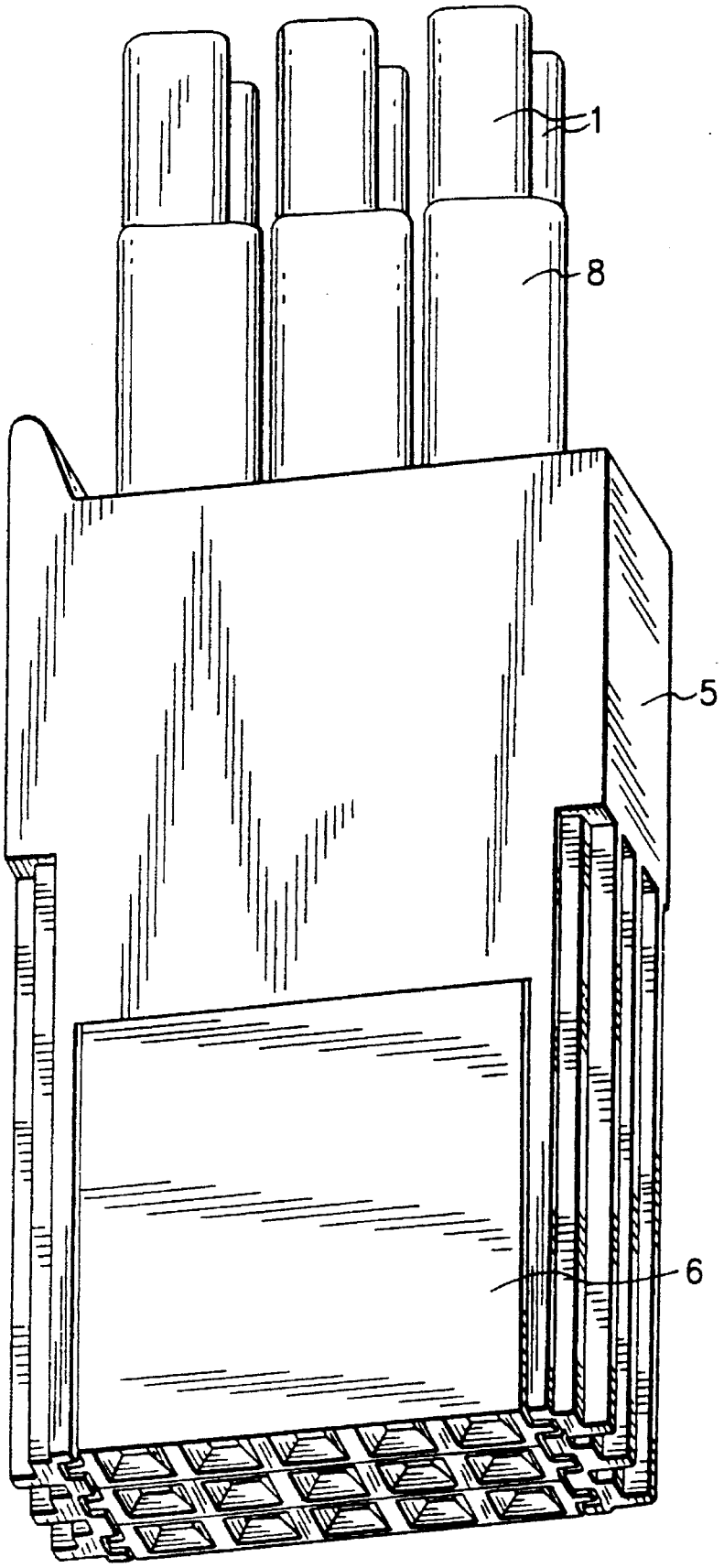
FIG. 4 shows the module cap with modules of FIG. 3, wherein all modules are in the assembled position.

As shown in FIG. 2, each module 6 comprises two outer walls 24, 25 extending in column direction, between which the contacts 18, 19 are received, wherein one outer wall 24 is shorter, so that a connection part 26 of the contacts 18, 19 is well accessible. For assembly of the described connector the signal conductors 2 and the ground conductors 3 can thereby easily be connected with the connecting parts 26 of the corresponding signal contacts 19 and ground contact 18, respectively, whereafter the connection with the connecting parts 26 can be established by soldering or the like. Thereafter, the module 6 is shifted into its position in the module cap 5. The connecting parts 26 of one module 6 are covered in the mounted position of FIG. 4 by the long outer wall 25 of the next module 6, wherein the connecting parts 26 of the module at an end of the module cap 5 are covered by a cover wall 27 of the module cap 5.

From the foregoing it will be clear that the connector described comprises a housing assembled of a module cap 5 and modules 6 detachably mounted in the module cap 5. In this manner connecting signal conductors 2 and ground conductors 3 to the connecting parts 26 of the contacts 18, 19 is very simple. Moreover, in case of a fault in the connection of one of the cables, maintenance of the connector can easily take place. Replacement of one of the modules 6 is also possible in an easy manner.

Of course, it is possible to make the module cap 5 with different dimensions, so that for example eight modules 6 can be mounted in the same. By providing some module caps 5 which are suitable for receiving different numbers of modules 6, it is possible to adapt the connector of the invention in accordance with the requirements of the user by combining different module caps 5. The adjacent module caps 5 can be attached to one another for example by a dovetail connection. The dimensions of the module caps 5 and the modules 6 are such that the spacing between the contacts 18, 19 in row direction within one module cap 5 is equal to the spacing between adjacent contacts 18, 19 of interconnected module caps 5. In the embodiment described this spacing in row direction is 2 mm, so that two differential pairs of signal conductors can be connected per mm spacing.

Figure 6:
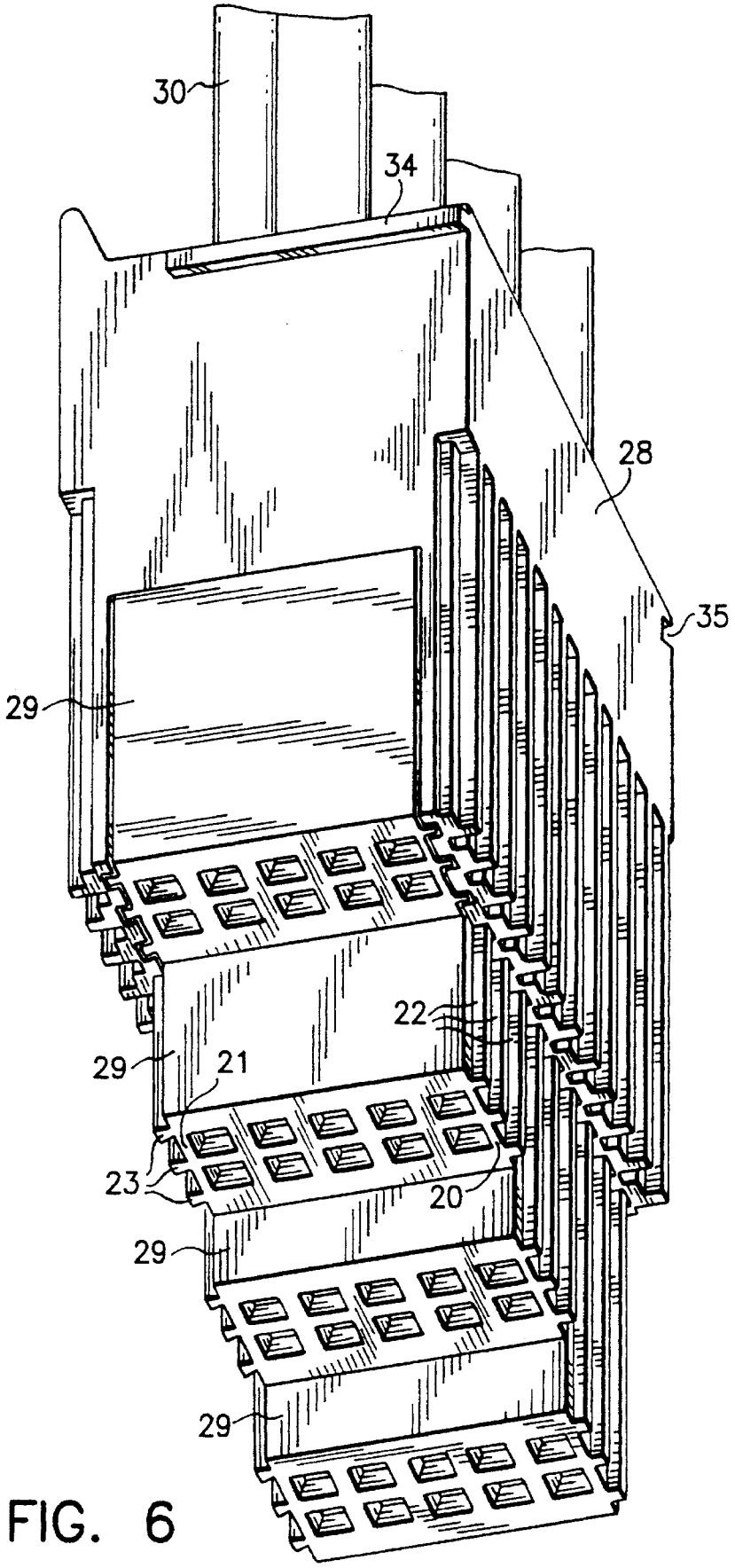
FIG. 6 shows a perspective view of a second embodiment of the connector of the invention, wherein four modules are shown in different positions with respect to the module cap.
Figure 7:
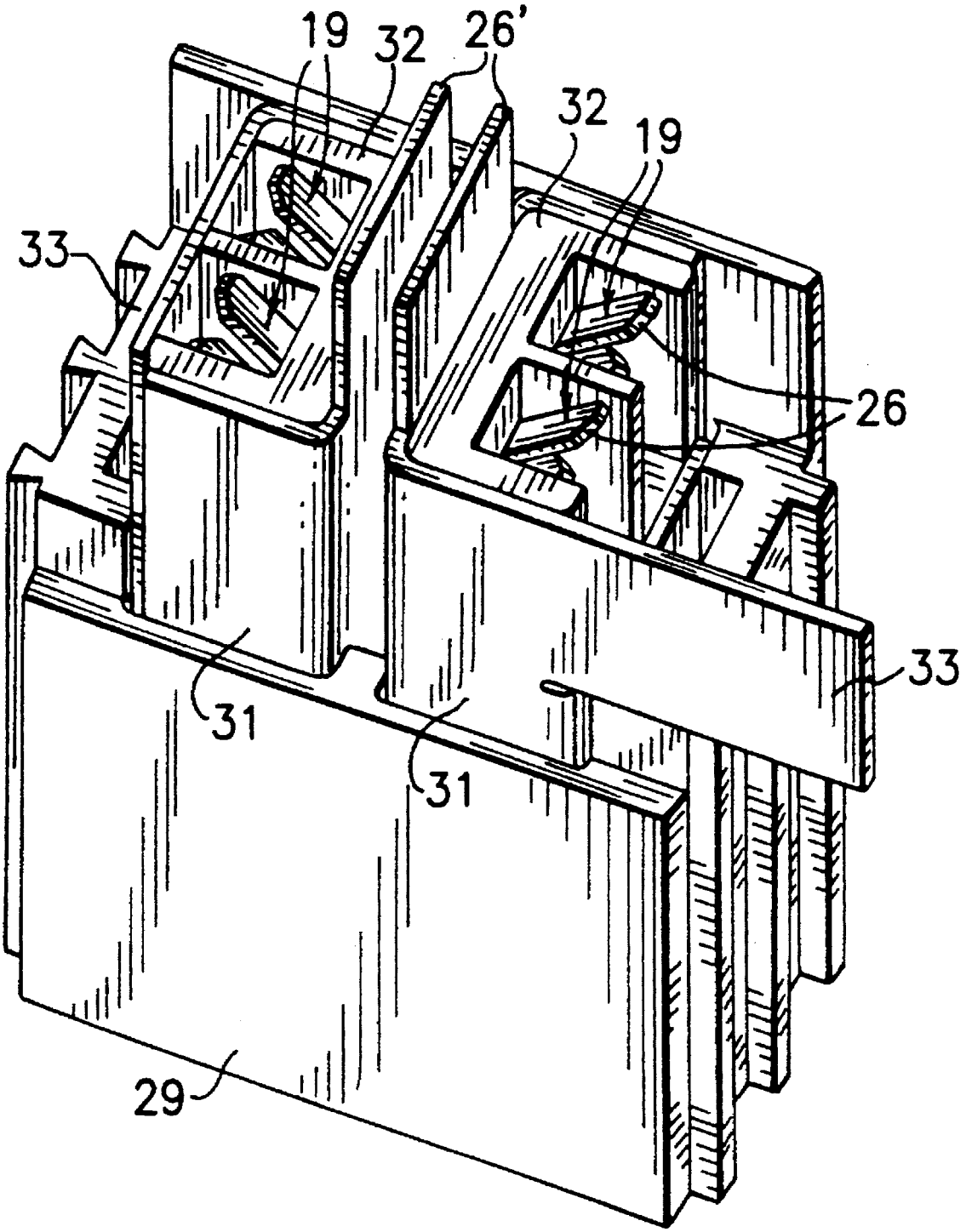
FIG. 7 shows a perspective view of one module of the connector of FIG. 6.
Figure 8:
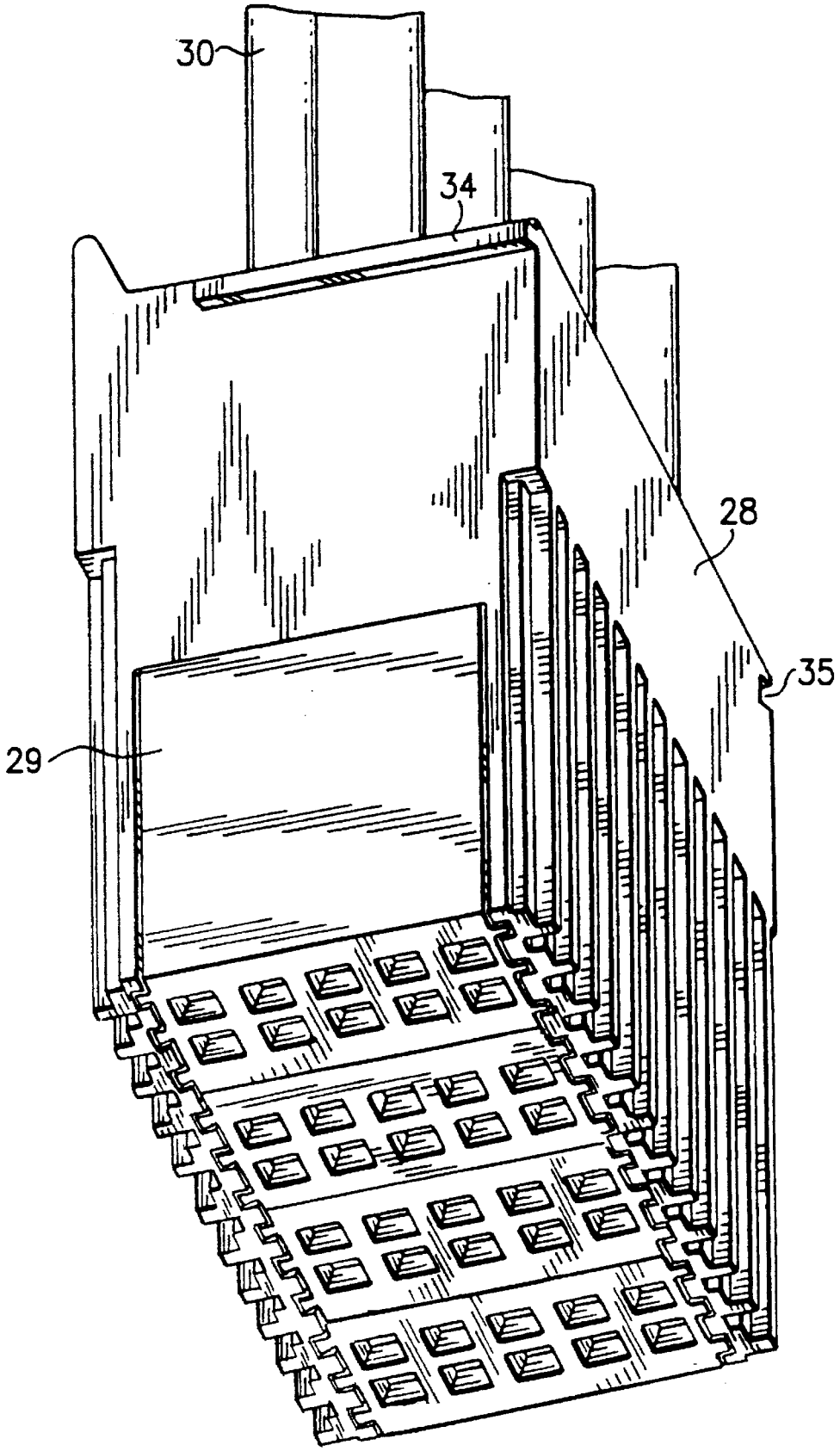
FIG. 8 shows the connector of FIG. 6, wherein all modules are in the assembled position.

The assembly of the housing of the connector of one or more module caps 5 and modules 6 also provides the possibility to make the connector suitable for different types of cables in a simple manner by providing modules 6 made in a different manner. Referring to FIGS. 6–8 there is shown an embodiment of the connector according to the invention, the housing of which is assembled of a module cap 28 in which four modules 29 are mounted. These modules 29 each are suitable for connecting two twinaxial cables 30.

In this embodiment the modules 29 each comprise two columns of locations for ground contacts 18 and signal contacts 19. FIG. 7 shows a perspective view of one module 29 wherein the connecting parts 26 of four signal contacts 19 can just be seen. Two signal contacts 19 adjacent in row direction are enclosed by an outer conductor 31, wherein a dielectrical intermediate piece 32 of insulating material lies between the signal contacts 19 and the outer conductor 31. Each outer conductor 31 includes a connecting part 26' for the ground conductor of the twinaxial cables 30. When the signal conductors of the twinaxial cable 30 are connected to the connecting parts 26 of the signal contacts 19, a closing lip 33 of the outer conductor 31 is bent into the position also shown in FIG. 7, so that a substantially uninterrupted shielding is maintained. Each of the outer conductors 31 can be connected with one or more ground contacts 18 not shown in FIGS. 6–8, whereby a desired configuration of signal and ground contacts can be obtained.

In this case the modules 29 are provided with three guiding ribs 22, 23 at their outer walls 20, 21, so that a module 29 occupies just the same space as three modules 6. For the remaining part the construction of the module cap 28 and the modules 29 fully corresponds with the construction described of the module cap 5 and the modules 6. It can be seen in FIGS. 6 and 8 that the module cap 28 at one end has a dovetail-shaped rib 34 and at the other end a complementary slot 35 for interconnecting successive module caps 28.

Figure 9:
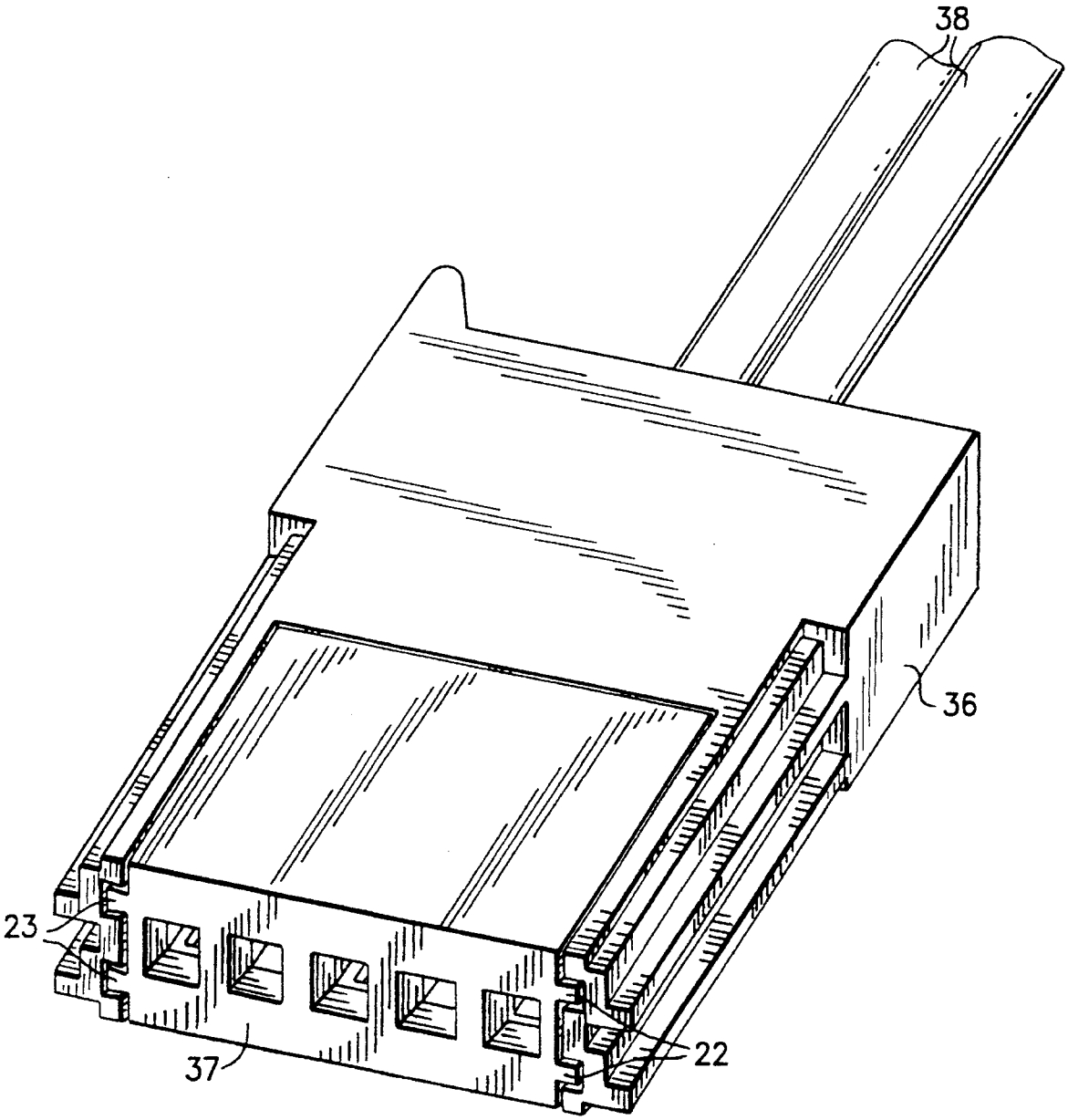
FIG. 9 shows a perspective view of a third embodiment of the connector according to the invention.
Figure 10:
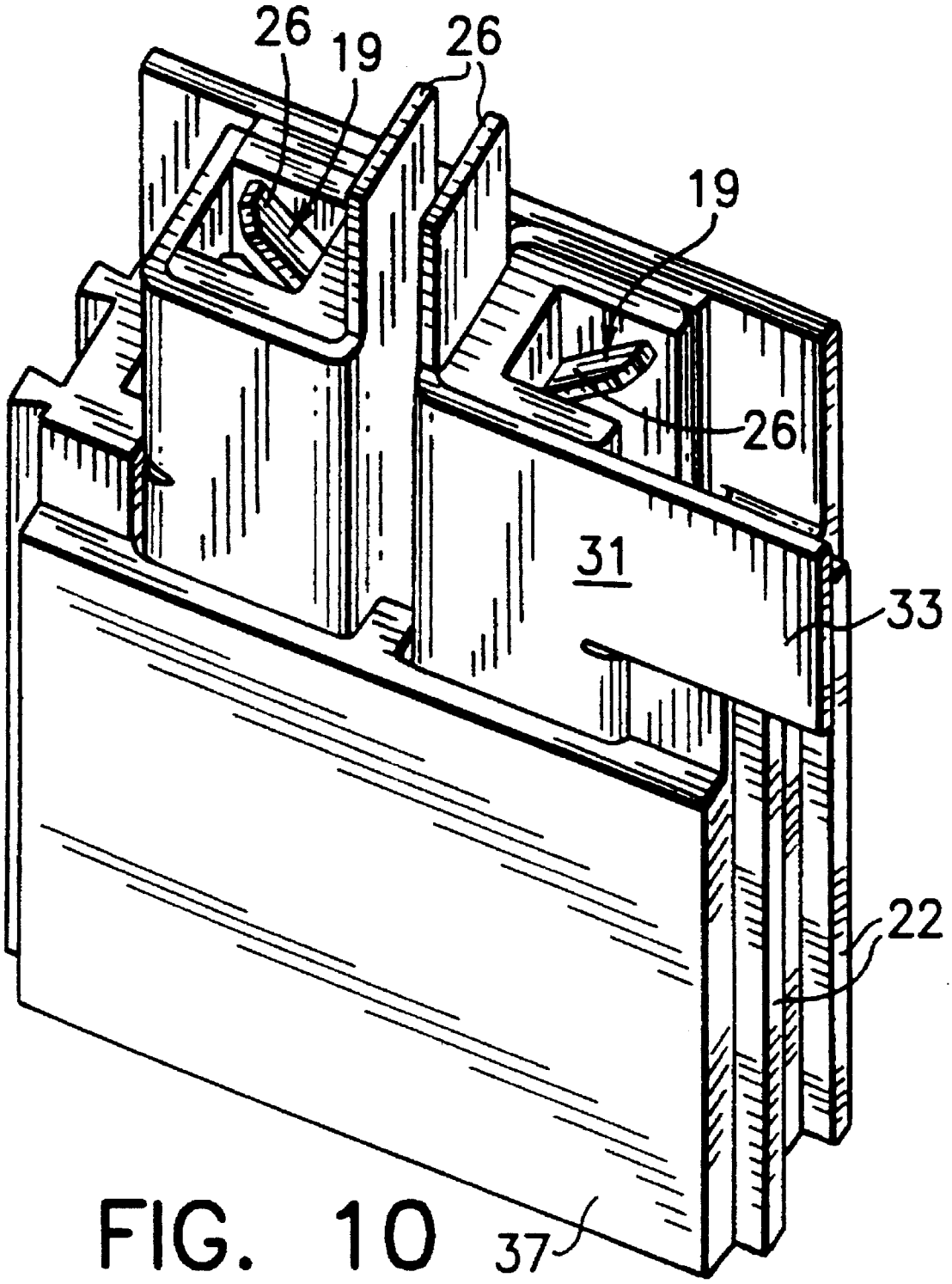
FIG. 10 shows a perspective view of a module of the connector of FIG. 9.

FIGS. 9 and 10 show a third embodiment of the connector according to the invention, wherein the housing is assembled of a module cap 36 in which only one module 37 is mounted. The construction of the module cap 36 and the module 37 again corresponds with the construction already described of the module cap 5 and the modules 6. In this case the module 37 is provided with two guiding ribs 22, 23, so that the module 37 occupies just the same space as two modules 6. The module 37 shown in a perspective view in FIG. 10, is intended for connecting two coaxial cables 38 and comprises a column of locations for ground contacts 18 and signal contacts 19 not further shown in the drawings. In the embodiment shown a signal contact 19 is located at both sides of a central ground contact 18, wherein the connecting parts 26 of the signal contacts 19 are shown in FIG. 10. In the same manner as in the above-described module 29, each signal contact 19 is enclosed by an outer conductor 31 with connecting part 26 for connecting the shielding of the coaxial cable 38. Each outer conductor 31 is connected to the central ground contact 18 on the one hand and on the other hand with a ground contact lying at the other side of the signal contact 19. Of course, other configurations of signal and ground contacts are possible.

Figure 11:
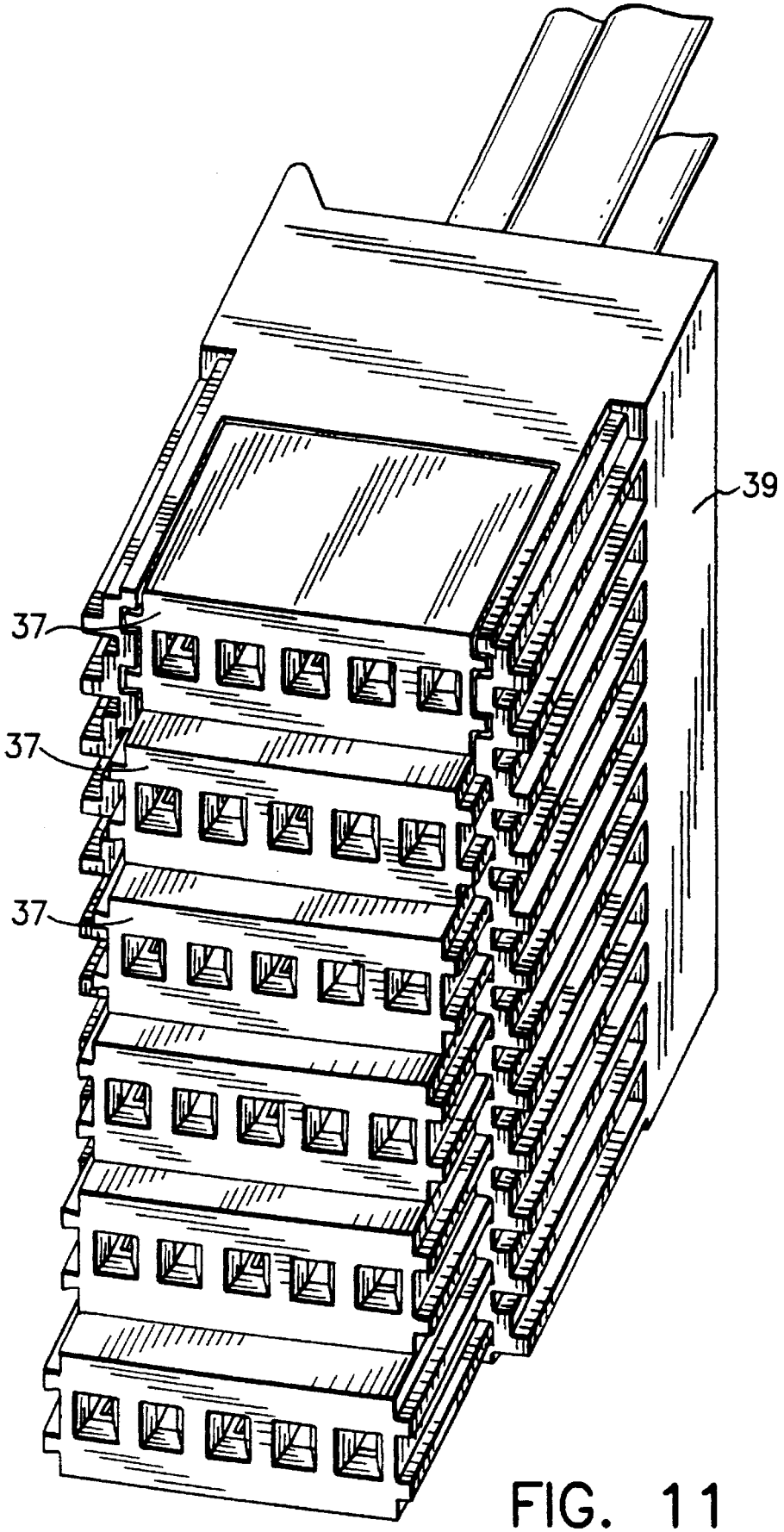
FIG. 11 shows a fourth embodiment of the connector according to the invention made with the module of FIG. 10.

Finally, FIG. 11 shows an embodiment of the connector according to the invention, the housing of which is assembled of a module cap 39 and six modules 37 mounted in the module cap.

From the foregoing it will be clear that the invention provides a connector which, by assembling one or some module caps 5, 28, 36 and/or 39 and modules 6, 29 and/or 37, is suitable for various applications for various numbers of different types of shielded cables. The assembly of the connector and connecting the conductors of the cables is very simple due to the modular construction. Moreover, replacement of parts which possibly show a fault, is possible.

It is noted that while maintaining the favourable modular construction different numbers of signal and ground contacts can be accommodated in one module depending on the desired configuration of signal and ground contacts in the connector.

The invention is not restricted to the above-described embodiments which can be varied in a number of ways within the scope of the invention.

We claim:

1. Connector for shielded cables, comprising a housing of insulating material with signal and ground contacts accommodated in said housing to which corresponding conductors of the shielded cables are connectable, said contacts being arranged in rows and columns, wherein the housing comprises at least one module and at least one module cap, wherein each module can be detachably mounted in a predetermined position in the module cap, and wherein each module is provided with at least one column of the contacts, each module comprising two outer walls extending in column direction with the signal and ground contacts being located between the outer walls, wherein one of the outer walls is shorter than the other outer wall to expose connection parts of the signal and ground contacts, wherein a cover wall is provided at one end of the module cap for covering the connection parts of the module.

2. Connector according to claim 1, further comprising different modules for different types of shielded cables, said different modules being adapted to be mounted in the same module cap.

3. Connector according to claim 1, wherein the module caps receive different numbers of modules, the size of the module caps in row direction being such that when the module caps are placed one against the other in row direction, the spacing between successive ones of said signal and ground contacts in row direction in a module cap is equal to the spacing between successive ones of said signal and ground contacts in module caps placed one against another.

4. Connector according to claim 1, wherein each module cap comprises strain relief means for the cables.

5. Connector according to claim 1, wherein each module cap comprises two opposite side walls extending in row direction, wherein the outer side of at least one of said side walls has a guiding profile adapted to cooperate with a complimentary guiding profile of a coupling socket.

6. Connector according to claim 1, wherein each module cap comprises two opposite side walls extending in row direction, wherein at least one of said side walls of the module cap is provided at its inner side with first guiding slots at a fixed intermediate spacing, wherein each module has at least one outer wall extending in row direction and comprising at least one guiding rib fitting into a first guiding slot of said one side wall.

7. Connector according to claim 6, wherein the other one of said side walls of the module cap is provided at its inner side with second guiding slots at a fixed intermediate spacing, said second guiding slots having a different shape than the shape of the first guiding slots, wherein each module at its other outer wall extending in row direction has at least one guiding rib fitting into a second guiding slot.

8. Connector according to claim 1, wherein said module comprises at least one column of contacts with a central one of said ground contact and two of said signal contacts at both sides thereof.

9. Connector according to claim 1, wherein said module comprises at least one of said signal contacts enclosed by an outer conductor connected with at least one of said ground contacts.

10. Connector according to claim 1, wherein said module comprises at least one pair of said signal contacts enclosed together by an outer conductor connected with at least one of said ground contacts.

11. Connector according to claim 1, wherein said module cap comprises two opposite side walls extending in row direction, wherein at least one of said side walls is provided at its inner side with first guiding slots at a fixed intermediate spacing.

12. Connector for shielding cables, the connector comprising a housing of insulating material with signal and ground contacts accommodated in said housing to which corresponding conductors of the cables are connectable, said contacts being arranged in rows and columns, wherein the housing comprises at least two modules and at least two module caps, wherein each module can be detachably mounted in a predetermined position in at least one of the module caps, and wherein each module is provided with at least one column of the contacts, wherein the size of said at least two module caps in row direction is such that when the module caps are placed one against the other in row direction, the spacing between successive ones of said signal and ground contacts in row direction in one of the module caps is equal to the spacing between successive ones of said signal and ground contacts in the module caps placed one against another.

* * * * *